United States Patent [19]

Pessina et al.

[11] Patent Number: 4,618,136

[45] Date of Patent: Oct. 21, 1986

[54] DEVICE FOR LOADING SIGNATURES FOR APPLICATION TO SIGNATURE LOCATING ASSEMBLIES IN BOOKBINDING APPARATUS

[76] Inventors: Giorgio Pessina; Aldo Perobelli, both of Via Timavo, 32, 20037 Paderno Dugnano, Milano, Italy

[21] Appl. No.: 603,437

[22] Filed: Apr. 24, 1984

[30] Foreign Application Priority Data

May 6, 1983 [IT] Italy ..... 21765 B/83

[51] Int. Cl.[4] ..... B65H 1/30; B65H 5/02

[52] U.S. Cl. ..... 271/150; 271/3.1; 271/161; 271/171; 271/209; 271/184; 271/188; 198/627

[58] Field of Search ..... 271/3.1, 31.1, 129, 271/144, 133, 149, 150, 151, 161, 171, 200, 209, 184, 185, 188, 169, 267; 414/123, 32; 198/409, 631, 627, 461, 462, 689, 579

[56] References Cited

U.S. PATENT DOCUMENTS

| | | | |
|---|---|---|---|
| 1,149,405 | 8/1915 | Peters | 271/267 |
| 2,606,762 | 8/1952 | Wockenfuss | 271/133 |
| 2,827,288 | 3/1958 | Geisler | 271/161 |
| 3,135,509 | 6/1964 | Zweig | 271/188 |
| 3,203,586 | 8/1965 | Downham | 221/56 |
| 3,231,063 | 1/1966 | Talbot | 198/627 |
| 3,572,695 | 3/1971 | Janirek | 271/191 |
| 3,598,227 | 8/1971 | Stanford | 198/627 |
| 3,627,307 | 12/1971 | Does | 271/19 |
| 3,814,000 | 6/1974 | Heisler | 271/3.1 |
| 3,881,719 | 5/1975 | Schmermund | 271/150 |
| 3,945,633 | 3/1976 | Knopp | 271/3.1 |
| 4,161,138 | 7/1979 | Marchetti | 148/627 |
| 4,183,517 | 1/1980 | Hageman et al. | 271/3.1 |
| 4,316,607 | 2/1982 | Hayashi et al. | 271/3.1 |
| 4,366,955 | 1/1983 | Pessina et al. | 271/200 |
| 4,403,899 | 9/1983 | Lampe et al. | 198/627 |

*Primary Examiner*—Douglas C. Butler
*Assistant Examiner*—James E. Barlow
*Attorney, Agent, or Firm*—Bucknam and Archer

[57] ABSTRACT

The device comprises a conveyor assembly for continuously feeding edge arranged signatures and provided with side guiding members for restraining and guiding the signatures at the end portion of the side guiding members in the signature feeding direction there being provided a narrowing width region for bending the signatures with a convexity facing the signature a feeding direction, feeding belt being further provided for picking the bent signatures and loading them, in a turned over condition, on a conveyor.

5 Claims, 8 Drawing Figures

DEVICE FOR LOADING SIGNATURES FOR APPLICATION TO SIGNATURE LOCATING ASSEMBLIES IN BOOKBINDING APPARATUS

BACKGROUND OF THE INVENTION

The present invention relates to a device for loading signatures and the like to be applied to sheet loading machines for bookbinding use.

More specifically the device affords the possibility of progressively reducing, by partially narrowing the feeding line, the weight applied on the signatures being conveyed to the sheet loading assembly, as said signatures are advanced towards a locating conveyor belt.

As is known, in a bookbinding process the signatures, that is the already bent sheets to be printed upon, are picked by means of a sheet or signature loading assembly which conveys them to a processing apparatus.

The mentioned picking operation, on the other hand, is affected by drawbacks because of the practical difficulties associated with disengaging the signatures from one another.

There are known signature loading apparatus which are effective to suitably feed, by means of a conveyor belt, the thereinabove mentioned sheet or signature loading assemblies.

However, these loading apparatus are not able of satisfactorily operating, since they feed the mentioned conveyor belt, usually obliquely arranged, by means of supplying means entraining or pushing the signatures, adjoining one another and in close mutual contact, towards said conveyor belt by causing said signatures to fall, upon tilting, on the conveyor belt itself.

Thus, since a proper signature disengaging step is lacking, said signatures may be unevenly conveyed to the sheet or signature loading assembly with consequent interruptions in the operation of the system.

SUMMARY OF THE INVENTION

Accordingly, the task of the present invention is to overcome the above mentioned drawback, by providing such a signature loading device which is able of feeding said signatures to a conveyor belt in a well separated relationship.

Within that task, it is a main object of the present invention to provide such a signature loading device which is adapted to feed the individual signatures to said conveyor belt with an imbricated type of arrangement.

Yet another object of the present invention is to provide such a signature loading device which is effective to evenly feed said signatures to the signature processing apparatus in such a way as to practically completely eliminate any interruptions in the operation of said processing apparatus.

According to one aspect of the present invention, the above task and objects, as well as yet other objects which will become more apparent hereinafter are achieved by a signature loading according to the main claim.

BRIEF DESCRIPTION OF THE DRAWINGS

Further characteristics and advantages of the signature loading device according to the present invention will become more apparent thereinafter by the following detailed description of a preferred embodiment thereof being illustrated, by way of example and not of limitation, in the accompanying drawings, where.

DESCRIPTION OF THE PREFERRED EMBODIMENTS

Figure 1:
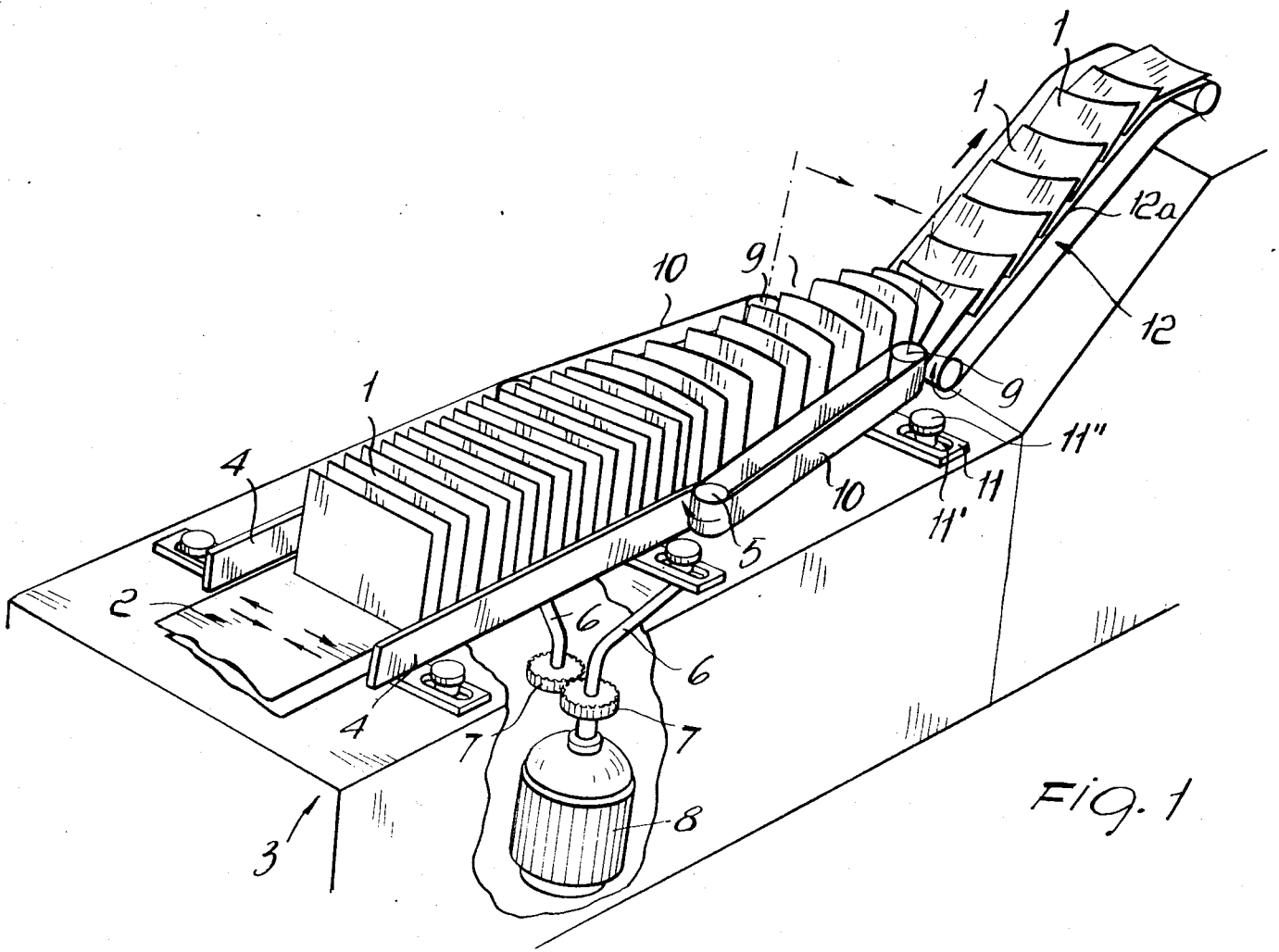
FIG. 1 is a schematic perpsective view of the signature loading device according to the present invention, arranged upstream of a continuous belt conveyor.

With reference to the figures of the accompanying drawings, the signature loading device according to the present invention comprises a signature (1) feeding apparatus preferably consisting of a continuous or closed-loop conveyor belt (2) mounted on a supporting frame (3).

The conveyor belt adjoins, for a length whereof, side guiding members (4) for restraining and guiding the signature, the spacing whereof may be adjusted depending on the width of the signatures.

At the right end portion (as shown in the Figures) of the mentioned side guiding members (4) there is provided a narrowing width portion defined by two opposite continuous or endless belt conveyors. More specifically in said narrowing width portion there are provided picking rollers (5) having a vertical axis and the spacing whereof is related to that of the side guiding members.

Said rollers are keyed on small shafts which are rotatively driven by flexible members (6), either directly or indirectly through a gear wheel pair (7) and a geared motor assembly (8).

With the mentioned driven rollers corresponding idle rollers (9) are effective to cooperate, which also have a substantially vertical axis and entrain, with said driven rollers, two closed-loop or endless belts (10). To this connection it should be noted that the belts 10 have a substantial height, essentially corresponding to that of the guiding members in such a way as to engage a substantial portion of the signatures vertical edges, thereby improving the bending of said signatures and contributing their stiffening.

The mentioned idle rollers, in particular, are mounted on cross adjusting brackets (11), provided with longitudinal slots 11' therethrough adjustable fixing members 11" are threaded for adjustably coupling the brackets 11 to the frame 3 and allowing for the respective rollers 9 to be moved in a linear fashion for adjusting purposes.

Accordingly, by bringing closer to one another the idle rollers 9, the signature feeding line width is narrowed by the desired amount.

In actual practice, as the signatures are conveyed towards the upwardly slanted conveyor (12) provided for conveying them to the sheet or signature loading device (not shown), the partial narrowing of said signature feeding line width affords the possibility of progressively reducing the weight exerted on each signature by the signature pack being fed.

Moreover, by the mentioned partial narrowing of the signature feeding line width, the signatures are caused to be bent thereby further improving separation thereof.

Obviously that effect will be provided as far as the individual sheets are held in contact with the mentioned side endless belts (10).

As the sheets will be passed through the mentioned belts, they will fall with a slightly accelerated motion facilitating the separation of two adjoining signatures, thereby providing an imbricated type of feeding, that is with a slightly offset partial superimposition of the individual signatures being advanced by the conveyor belt (12).

Figure 2:
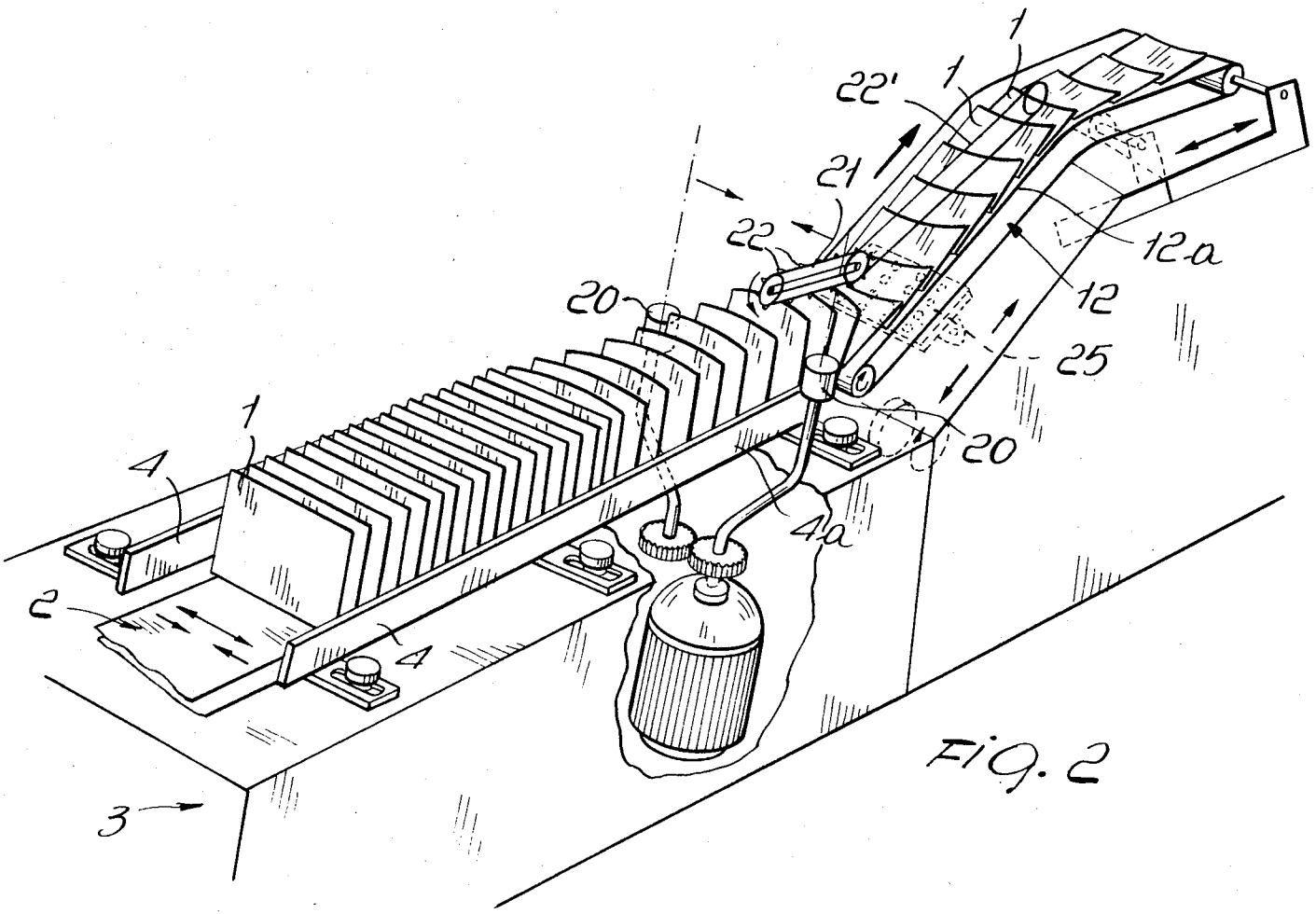
FIG. 2 is another schematic perspective view illustrating another embodiment of the signature loading device according to the invention.

According to the embodiment illustrated in FIGS. 2 to 6, the narrowing width region is defined by tapering at 4*a* right end (as shown in FIG. 2) of the side guiding members (4) while holding the height thereof substantially unchanged.

At the outlet of the mentioned tapering portion (4*a*) there are arranged signature feeding means, consisting of feeding rollers (20), having substantially vertical axes, and coupled to the motor 8, like the rollers (5), and which are provided for engaging with the vertical edges or the bent signatures (1).

At that same region a signature tilting member engages with the horizontal top edge of the signatures, which tilting member is advantageously formed by an endless belt (21) provided with lugs (22) engaging the top edges of the signatures to facilitate the tilting thereof on the conveyor (12).

On the upwardly slanted portion (12*a*) of the conveyor (12) there is advantageously provided a further guiding belt indicated at 22′, abutting the top surface of the imbricated signatures for preventing them from slipping out.

Figure 3:
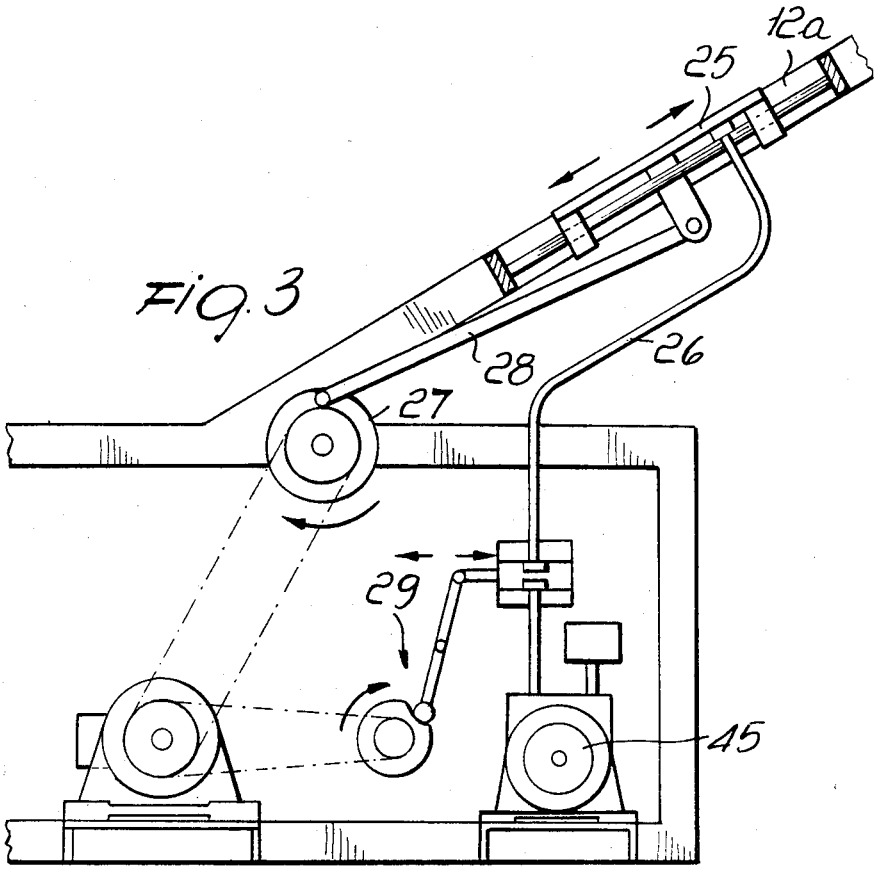
FIG. 3 is a side elevation view illustrating a sucking assembly as associated with the upwardly slanted portion of the conveyor.
Figure 4:
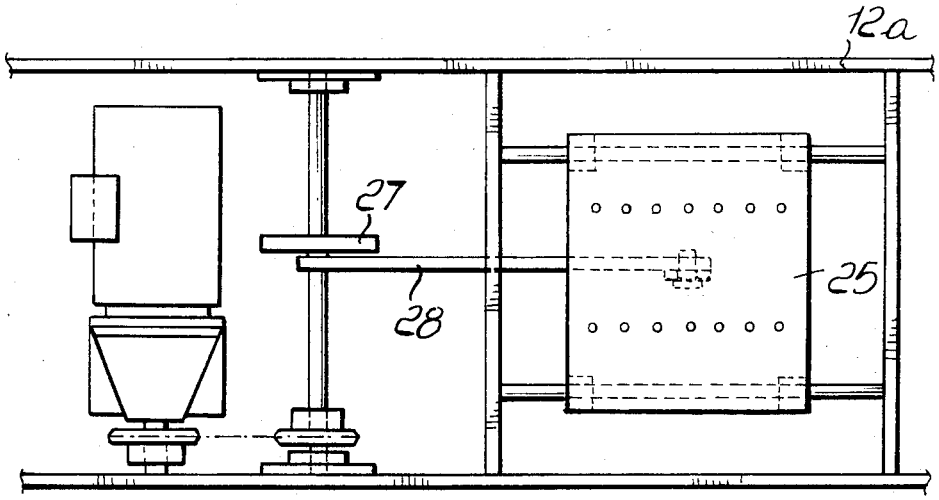
FIG. 4 is a top view of the mentioned sucking assembly.
Figure 5:
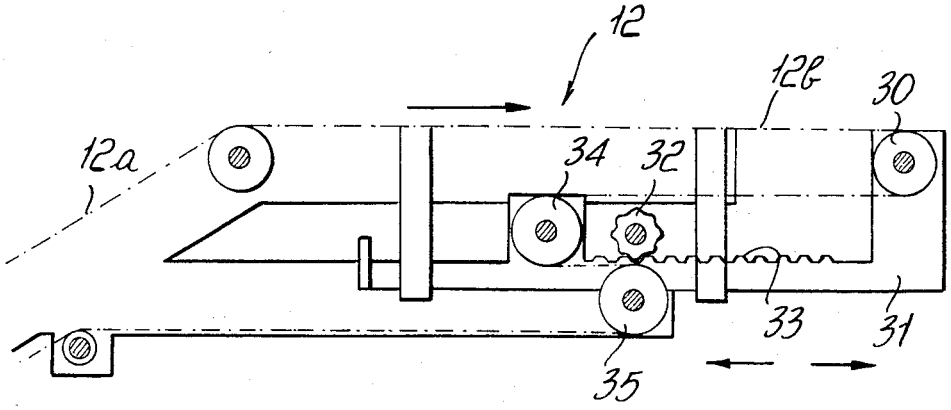
FIG. 5 is a side elevation view illustrating the end portion of the conveyor.
Figure 6:
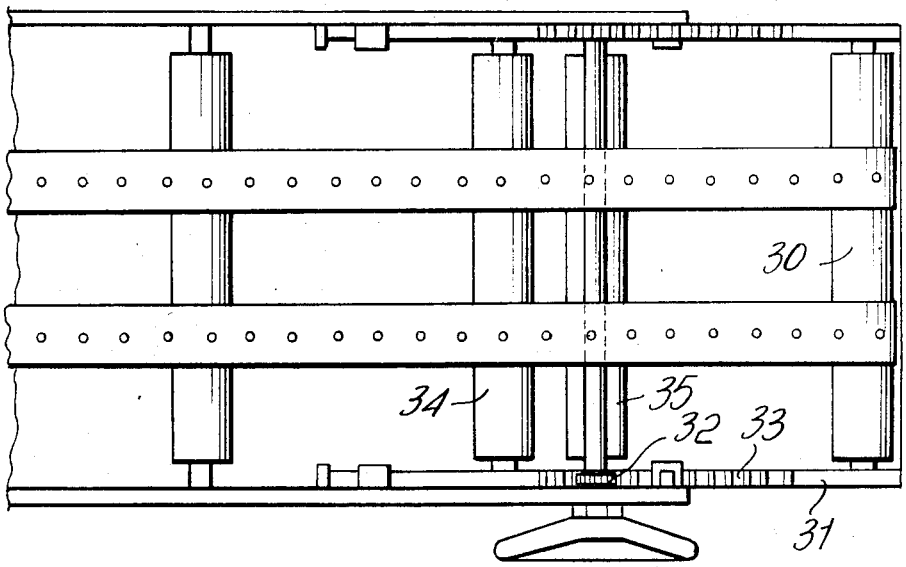
FIG. 6 is a top view illustrating the end portion of the conveyor.

In order to facilitate the guiding of the imbricated signatures there is moreover provided a sucking assembly (25) slidingly reciprocating under the operative leg of the upwardly slanted length of a conveyor (12) and coupled, through the duct (26), to a vacuum source (45) (see FIG. 3).

More specifically, the motion is transmitted through a cam 27-connecting rod 28 assembly (FIGS. 3 and 4) and timing means (29) are provided to shut off sucking during the downward movement of the sucking assembly (25).

The flat end portion of the conveyor (12), indicated at (12*b*), has advantageously a variable operative length, in order to fit the signature feeding or loading device; to that end, the end roller (30) of the conveyor (12) is mounted on a movable frame (31), slidingly supported by the frame of the conveyor (12) and may be driven through a pinion 32 rack 33 assembly, effective to provide sliding in the two directions.

Adjusting rollers (34 and 35) are further provided for holding the length of the conveyor (12) at a constant value, independently from the position of the movable frame (31).

Figure 7:
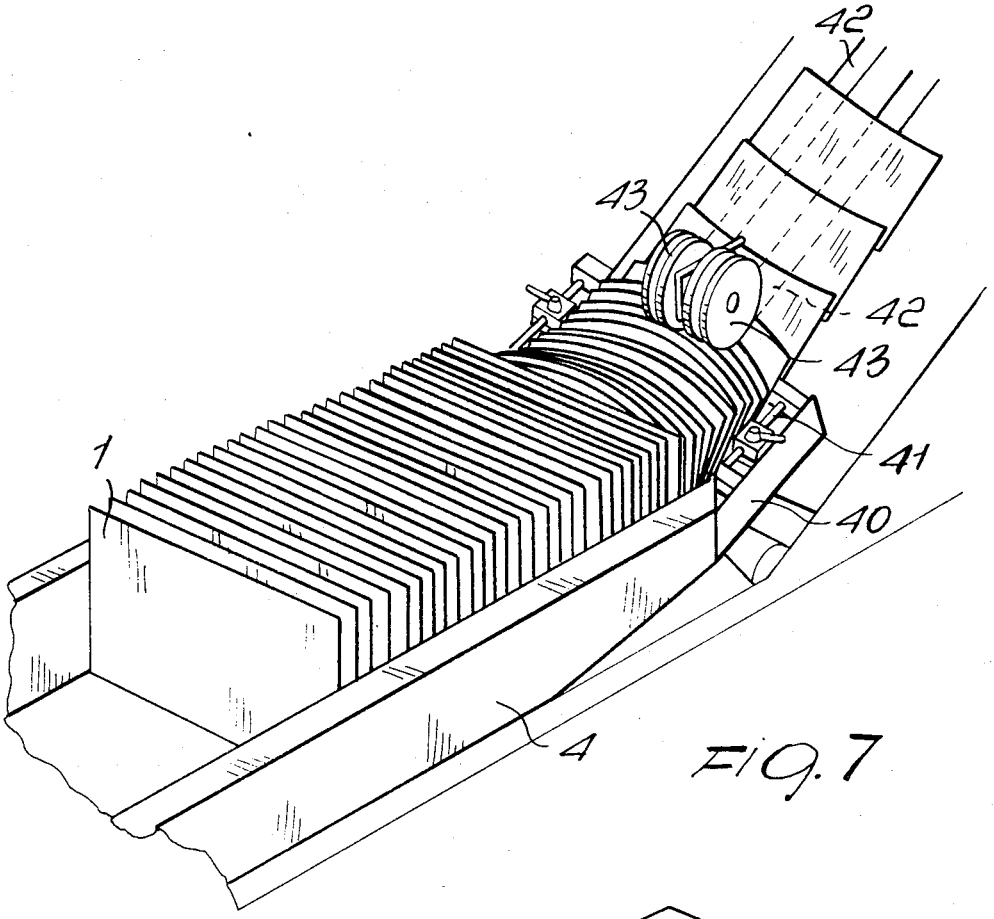
FIG. 7 illustrates another embodiment of the signature loading device according to the present invention.
Figure 8:
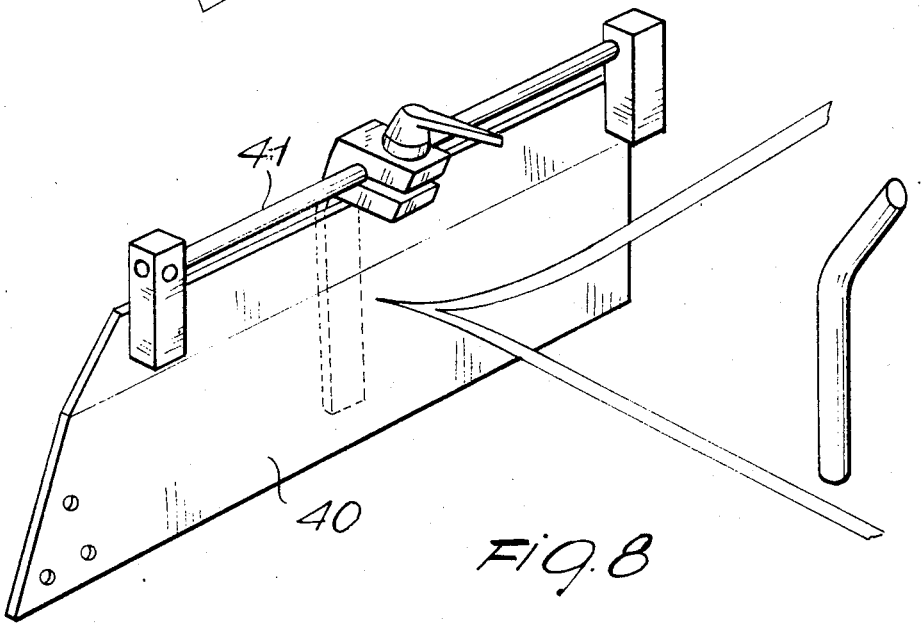
FIG. 8 is a perspective view illustrating a detail of the baffle members used in the embodiment of FIG. 7.

With reference to FIGS. 7 and 8, a further embodiment is herein illustrated, in which the narrowing width region consists of a pair of baffle wings (40), arranged at the end of the side guiding members or walls (4) and supported by slanted rods (41) in such a way as to be able of being reciprocated and translated in order to fit the different processing steps.

The feeding or advancing means advantageously consist of entraining belts (42), endless extending, and rollers (43) engaging with the upper edge of the signatures (1), to be turned over, and arranged above said signatures, during the movement of said signatures on the upwardly slanted portion (12*a*) of the conveyor (12).

With the above disclosed devices, the processing apparatus, arranged downstream of the latter, is supplied in a very even way, with the signatures properly arranged.

Thus the system will be prevented from accidentially stopping as it occurs in the known signature processing systems.

While preferred embodiments of the signature loading device according to the invention have been thereinabove illustrated, it should be apparent that the disclosed embodiments are susceptible to many modifications and variations all falling within the spirit and scope of the invention, as defined in the accompanying claims.

We claim:

1. A signature loading device to be applied to signature loading apparatus for bookbinding machines comprising a conveyor belt for continuously feeding edge arranged signatures and provided with side guiding members for restraining and guiding said signatures, at the outlet end of said guiding members there being provided a narrowing width portion for bending said signatures with a convexity facing said signature feeding direction and for loading said signatures on a further upwardly slanted conveyor belt, said narrowing width portion engaging said signatures for a heigth substantially equal to that of said guiding members, said narrowing width portion consisting of a pair of endless driven opposite converging belts arranged as extensions of a respective said guiding member, each said converging belt extending between two vertical axis driving and driven rollers, the driven roller of said rollers being adjustably mounted on a respective slotted bracket member.

2. A signature loading device according to claim 1 wherein said narrowing width portion consists of a converging portion integrally formed with said guiding members, and having a heigth substantially equal to that of said guiding members, said signature driving means consisting of feeding vertical axis rollers arranged at the outlet of said converging portion.

3. A signature loading device according to claim 1 wherein said narrowing width portion consists of a pair of baffle wings arranged as extensions at the outlet portions of said guiding members and having a heigth substantially like to the heigth of said guiding members, said wings being supported by slanted rods in such a way as to be able of reciprocating and translating, said signature driving means consisting of entraining belts and rollers engaging with the top edge of said signatures being fed.

4. A signature loading device according to claim 2 wherein a signature tilting endless belt is provided at the outlet of said narrowing width converging portion, said tilting belt being provided with lugs effective to engage with the top edges of said bent signatures for tilting them on said upwardly slanted conveyor belt.

5. A signature loading device according to claim 1, wherein, at the outlet end of said upwardly slanted conveyor belt, there is provided a further conveyor belt of adjustable length for fitting said upwardly slanted conveyor belt to a signature processing apparatus, said adjustable length conveyor belt being entrained on a roller rotatably supported on a movable frame.

* * * * *